US011520249B2

(12) United States Patent
Nagaoka et al.

(10) Patent No.: US 11,520,249 B2
(45) Date of Patent: Dec. 6, 2022

(54) ELECTROPHOTOGRAPHIC MEMBER, ELECTROPHOTOGRAPHIC PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Kazuaki Nagaoka, Shizuoka (JP); Toru Ishii, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/697,503

(22) Filed: Mar. 17, 2022

(65) Prior Publication Data

US 2022/0308496 A1 Sep. 29, 2022

(30) Foreign Application Priority Data

Mar. 24, 2021 (JP) ..... JP2021-050145

(51) Int. Cl.
*G03G 15/08* (2006.01)
*G03G 15/16* (2006.01)
*G03G 15/02* (2006.01)

(52) U.S. Cl.
CPC ..... *G03G 15/0818* (2013.01); *G03G 15/0233* (2013.01); *G03G 15/0808* (2013.01); *G03G 15/1685* (2013.01)

(58) Field of Classification Search
CPC ..... G03G 15/0233; G03G 15/0808; G03G 15/0818; G03G 15/1685
See application file for complete search history.

(56) References Cited

U.S. PATENT DOCUMENTS

| | | | | |
|---|---|---|---|---|
| 2013/0039677 | A1 | 2/2013 | Nose et al. | |
| 2017/0168405 | A1* | 6/2017 | Uchida | G03G 15/161 |
| 2020/0310283 | A1* | 10/2020 | Ogawa | G03G 15/0818 |
| 2022/0100113 | A1* | 3/2022 | Tanaka | G03G 21/1814 |

FOREIGN PATENT DOCUMENTS

| | | | |
|---|---|---|---|
| EP | 1513026 | A2 | 3/2005 |
| EP | 3239781 | A1 | 11/2017 |
| EP | 3715959 | A1 | 9/2020 |
| JP | 2007212646 | A | 8/2007 |
| JP | 2017201390 | A | 11/2017 |
| JP | 2020166227 | A | 10/2020 |
| JP | 2020170158 | A | 10/2020 |

* cited by examiner

*Primary Examiner* — Joseph S Wong
(74) *Attorney, Agent, or Firm* — Canon U.S.A., Inc., IP Division

(57) ABSTRACT

An electrophotographic member includes an electro-conductive substrate and an elastic layer containing inorganic particles and a binder resin. The electrophotographic member has a protrusion on an outer surface of the electrophotographic member containing the inorganic particles. At least part of the inorganic particles contained in the protrusion are exposed to a surface of the protrusion, and the binder resin is present among the inorganic particles contained in the protrusion. An elastic modulus E1 of the binder resin measured at a first region in a cross-section in a thickness direction of the elastic layer is equal to or above 1000 MPa.

9 Claims, 5 Drawing Sheets

ELECTROPHOTOGRAPHIC MEMBER, ELECTROPHOTOGRAPHIC PROCESS CARTRIDGE, AND ELECTROPHOTOGRAPHIC IMAGE FORMING APPARATUS

BACKGROUND

Technical Field

The present disclosure relates to an electrophotographic member, an electrophotographic process cartridge, and an electrophotographic image forming apparatus.

Description of the Related Art

In recent years, electrophotographic image forming apparatuses using electrophotography, such as copiers, facsimiles, and printers, have been facing increasing demands for printing more sheets faster than ever with less power consumption among other things. Along with these demands, performances required for various electrophotographic members and toners used in the electrophotographic image forming apparatuses are also becoming extremely high. Regarding the demand for less power consumption in particular, reduction in fixing temperature (low-temperature fixation) is becoming a mainstream movement as a printer. Along with this movement, toners that are melted and fixed properly at a low temperature are expected.

When the toner designed for low-temperature fixation as mentioned above is used for repeated printing while employing the publicly known electrophotographic member, the toner is prone to destruction due to friction with the electrophotographic member or heat and pressure associated with the friction. Accordingly, toner components may stick to and get deposited on the electrophotographic member or a surface of an image bearing member which are in contact with the toner, whereby original functions of the components may be hindered as a consequence. This hindrance will complicate continuous output of high-quality images.

Japanese Patent Application Laid-Open No. 2020-170158 discloses a developing roller that can suppress contamination of an outer surface of a photoreceptor more reliably even in a case of reducing a contact pressure of a cleaning blade against the photoreceptor.

The inventors of the present disclosure have studied the developing roller according to Japanese Patent Application Laid-Open No. 2020-170158, and have encountered cases where toners stick to surfaces of image bearing members when many sheets are printed under a high-temperature and high-humidity environment by using toners designed for low-temperature fixation.

SUMMARY

At least one aspect of the present disclosure is directed to providing an electrophotographic member, which can be used as a developing unit that can keep a toner from sticking to a surface of an image bearing member even when electrophotographic images are formed for a long period under a high-temperature and high-humidity environment while using a toner designed for low-temperature fixation. Another aspect of the present disclosure is directed to providing an electrophotographic process cartridge and an electrophotographic image forming apparatus, which contribute to stable formation of high-quality electrophotographic images.

According to one aspect of the present disclosure, there is provided an electrophotographic member including an electro-conductive substrate and an elastic layer, the elastic layer containing inorganic particles and a binder resin, the electrophotographic member having a protrusion on an outer surface of the electrophotographic member, the protrusion containing the inorganic particles, at least part of the inorganic particles contained in the protrusion being exposed to a surface of the protrusion, the binder resin being present among the inorganic particles contained in the protrusion, wherein when measuring an elastic modulus E1 of the binder resin (14) at a first region in a cross section in a thickness direction of the elastic layer (12), where the first region is between an outer surface of the elastic layer and a position at a depth of 0.1 μm from the outer surface, the elastic modulus E1 is equal to or above 1000 MPa.

According to another aspect of the present disclosure, there is provided an electrophotographic process cartridge configured to be attachable to and detachable from a body of an electrophotographic image forming apparatus, the electrophotographic process cartridge including the above-described electrophotographic member.

According to still another aspect of the present disclosure, there is provided an electrophotographic image forming apparatus including an image bearing member configured to bear an electrostatic latent image, a charging device configured to primarily charge the image bearing member, an exposure device configured to form the electrostatic latent image on the primarily charged image bearing member, a developing unit configured to form a toner image by developing the electrostatic latent image with a toner, and a transfer device configured to transfer the toner image to a transfer material, wherein the developing unit comprises the electrophotographic member.

Further features of the present disclosure will become apparent from the following description of exemplary embodiments with reference to the attached drawings.

DESCRIPTION OF THE EMBODIMENTS

<Electrophotographic Member>

Figure 1A:
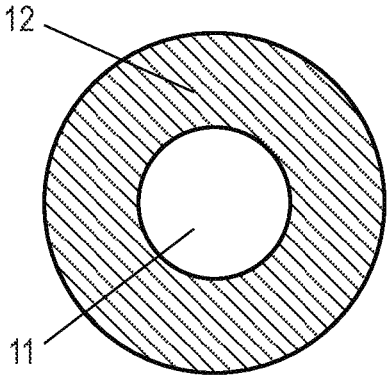
FIG. 1A is a schematic cross-sectional view showing an example of an electrophotographic member according to the present disclosure.
Figure 1B:
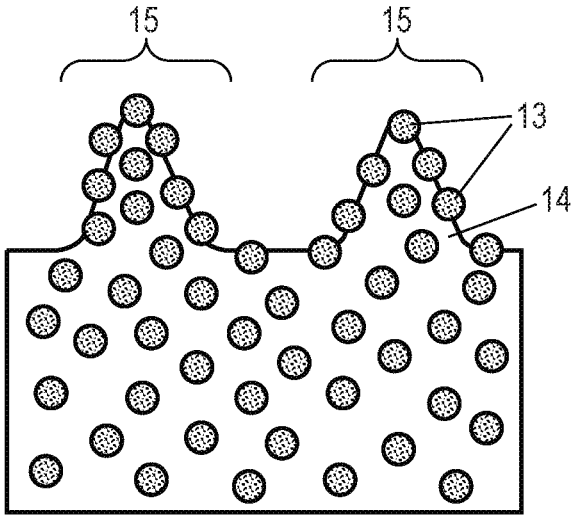
FIG. 1B is an enlarged schematic cross-sectional view of an outer surface of the electrophotographic member according to the present disclosure.

FIGS. 1A and 1B show an electrophotographic member according to an embodiment of the present disclosure.

As shown in FIG. 1A, the electrophotographic member of the present disclosure includes an electro-conductive substrate 11 and an elastic layer 12 that is provided on an outer periphery thereof. Meanwhile, as shown in FIG. 1B, this electrophotographic member has protrusions 15 on an outer surface thereof. Each protrusion 15 contains inorganic particles 13. Moreover, at least part of the inorganic particles 13 contained in the protrusions 15 are exposed to outer surfaces of the protrusions 15, and a binder resin 14 is present between the inorganic particles 13 contained in the protrusions 15.

[Electro-Conductive Substrate]

An electro-conductive mandrel having either a columnar shape or a hollow cylindrical shape, or a structure formed by forming one or more layers of conductive intermediate layers on this mandrel can be used as the electro-conductive substrate.

The shape of the mandrel is either the columnar shape or the hollow cylindrical shape. The mandrel is formed from any of the following conductive materials, namely: a metal or an alloy such as aluminum, a copper alloy, and stainless steel; iron subjected to a plating process with chromium or nickel; and an electro-conductive synthetic resin. A publicly known adhesive may be coated on surfaces of the electro-conductive mandrel and of the substrate for the purpose of improving adhesiveness to the intermediate layer, the elastic layer, and the like provided on the outer peripheries thereof.

[Elastic Layer]

The elastic layer is a layer to be formed on the mandrel or on an outer surface of the mandrel through the intermediate layer. The elastic layer of the present disclosure contains the binder resin and the inorganic particles. Meanwhile, the elastic layer may contain an electro-conductivity imparting agent and other additives in order to manifest properties such as electro-conductivity and intensities required for the electrophotographic member.

(Binder Resin)

The binder resin in the elastic layer is preferably a cross-linked material of a rubber having a cross-linking property. A diene rubber is a typical example of the rubber of this kind.

Examples of the diene rubber include natural rubber, isoprene rubber (IR), acrylonitrile butadiene rubber (NBR), styrene butadiene rubber (SBR), butadiene rubber (BR), chloroprene rubber (CR), and epichlorohydrin rubber.

The diene rubber contributes to further enhancement in hardness in the vicinity of a surface of the elastic layer attributed to cross-link of double bonds included in the diene rubber as a consequence of a surface treatment such as ultraviolet irradiation to be described later.

(Inorganic Particles)

In the electrophotographic member of the present disclosure, part of the inorganic particles are exposed to the surfaces of the protrusions provided to the outer surface. The inorganic particles used in the electrophotographic member of the present disclosure only need to have certain hardness and a metal compound and the like are applicable thereto. Examples of the metal compound include silicon oxide, titanium oxide, zinc oxide, strontium titanate, aluminum oxide, magnesium oxide, copper oxide, and tin oxide, which are generally added to electrophotographic members as fillers, coagents, and the like to be described later. Among these substances, it is preferable to use any of titanium oxide, zinc oxide, aluminum oxide, and magnesium oxide because these substances can bring about additional effects such as a charge imparting performance by exposing part of the inorganic particles to the surface.

The inorganic particles are used in a range from not less than 1 part by mass and not more than 30 parts by mass relative to a total quantity of 100 parts by mass of the binder resin from the viewpoint of achieving both scraping ability and rubber elasticity as discussed in the present disclosure. Moreover, a grain size of the used inorganic particles is preferably equal to or below 1 μm. By setting the grain size equal to or below 1 μm, irregularities formed by the exposure of the inorganic particles have sizes in the submicrometer order. Accordingly, it is possible to improve the scraping ability against external additives that cause contamination of surfaces of other members.

Here, the "grain size" is an arithmetic mean value (an average grain size) of measured diameters of 500 or more grains of the inorganic particles that are randomly captured by means of observation with a transmission microscope. In measuring the diameters, a mean value of a maximum major axis Lm and a maximum width Wm orthogonal to the maximum major axis is defined as a diameter of each of the particles, and the average grain size is calculated by using the values thus obtained.

Basically, exposure of the inorganic particles to the surfaces of the protrusions is promoted by conducting an ultraviolet treatment to be described later at an appropriate integrated light intensity. Here, a method of conducting energy dispersive X-ray spectroscopy (EDX) and comparing an element content on an outermost surface of the electrophotographic member with an element content of inside of the electrophotographic component to be calculated based on peak intensities originating from the inorganic particles is thought to be an example of an index for checking how much the inorganic particles are exposed. It is possible to indicate how much the inorganic particles are exposed to the outermost surface by comparing the element content obtained from the outermost surface with the element content obtained from the inside.

A degree of exposure on the outermost surface cannot be directly checked by the EDX due to intrusion of an electron beam in an amount of several micrometers. However, due to the exposure of the inorganic particles to the outermost surface, the peak intensity originating from the inorganic particles on the outermost surface is detected higher as compared to that of the inside. For this reason, it is possible to check the degree of exposure of the inorganic particles by comparing the peak intensities between the inside and the outermost surface. Meanwhile, the amount of intrusion of the electron beam becomes lower when an acceleration voltage is set as low as possible, thus facilitating detection of a condition on the outermost surface. Accordingly, an analysis with the acceleration voltage of 5 kV is adopted in the present disclosure.

From the viewpoint of causing the electrophotographic member according to the present disclosure to manifest sufficient toner scraping ability, an element content A on the outermost surface is preferably higher than an element content B of the inside in terms of the element contents on the outermost surface and of the inside to be calculated in the case of conducting the EDX with the acceleration voltage of 5 kV. Meanwhile, the element content A on the outer surface is more preferably equal to or above 130% of the element content B of the inside because this case suggests the sufficient exposure of the inorganic particles to the outermost surface.

(Electro-Conductivity Imparting Agent)

It is possible to impart electro-conductivity to the elastic layer by blending the electro-conductivity imparting agent such as an electronically conductive material or an ionically conductive material into the elastic layer. The following materials represent examples of the electronically conductive material, namely: an electro-conductive carbon material as typified by carbon black such as Ketjenblack EC and acetylene black; a carbon material for rubber such as Super Abrasion Furnace (SAF), Intermediate SAF (ISAF), High Abrasion Furnace (HAF), Fast Extruding Furnace (FEF), General Purpose Furnace (GPF), Semi-Reinforcing Furnace (SRF), Fine Thermal (FT), and Medium Thermal (MT); a carbon material for color (ink) subjected to an oxidation treatment; and a metal such as copper, silver, and germanium and a metal oxide thereof. Among these materials, the electro-conductive carbon material is particularly preferable because it is easier to control the electro-conductivity by using a small amount of such a material. The following materials represent examples of the ionically conductive material, namely: an inorganic ionically conductive material such as sodium perchlorate, lithium perchlorate, calcium perchlorate, and lithium chloride; and an organic ionically conductive material such as modified aliphatic dimethylammonium ethosulphate and stearylammonium acetate.

A required amount of any of these electro-conductivity imparting agents is blended as appropriate to meet the electro-conductivity needed by each electrophotographic member.

(Other Additives)

The elastic layer may further contain various additives as represented by particles, an electro-conductive agent, a plasticizer, a filler, a bulking agent, a cross-linking agent, a cross-linking promoter, a vulcanization assistant, a coagent, an acid accepting agent, a hardening inhibitor, an oxidation inhibitor, an aging inhibitor, and the like as needed. It is possible to blend any of these optional components in an amount within such a range that does not affect characteristic features of the present disclosure.

Examples of the cross-linking agent include a sulfur product such as powdered sulfur, oil treated powdered sulfur, precipitated sulfur, colloidal sulfur, and dispersed sulfur, and a sulfur-based cross-linking agent as typified by a sulfur-containing organic compound such as tetramethylthiuram disulfide and N,N-dithiobis morpholine.

A blending ratio of sulfur is preferably set equal to or above 0.5 part by mass and equal to or below 2.0 parts by mass relative to a total of 100 parts by mass of the binder resin in consideration of imparting favorable characteristics as rubber. Meanwhile, when the sulfur-containing organic compound is used as the cross-linking agent, it is preferable to adjust the amount of sulfur in molecules to a proportion within the aforementioned range.

Examples of the cross-linking promoter for promoting the cross-linking include a thiuram promoter, a thiazole promoter, a thiourea promoter, a guanidine promoter, a sulfenamide promoter, a dithiocarbaminate promoter, and the like. An appropriate amount of the cross-linking promoter is blended in accordance with a vulcanization rate required to meet molding conditions and a shape of a molded product.

Examples of the coagent include a metal compound such as zinc oxide, and publicly known conventional coagents such as stearic acid, oleic acid, and fatty acids. When the coagent is used, a content ratio of the coagent is preferably set equal to or above 0.1 part by mass and equal to or below 7.0 parts by mass relative to the total of 100 parts by mass of the binder resin.

The acid accepting agent is used for preventing chlorine-containing gas generated out of epichlorohydrine rubber, CR, and the like in the course of cross-linking from remaining inside the finished electrophotographic member and from developing cross-linking inhibition or contamination of the other members and the like caused by the remaining chlorine-containing gas. Although various materials that act as acid acceptors can be used as the acid accepting agent, it is preferable to use hydrotalcites and the like, which are excellent in dispersibility.

Examples of materials usable as the filler include zinc oxide, silica, carbon black, talc, calcium carbonate, magnesium carbonate, aluminum hydroxide, and the like. An improvement in mechanical strength of the binder resin can be expected from blending any of these filler materials. Meanwhile, it is also possible to impart electro-conductivity to the electrophotographic member as mentioned above by using conductive carbon black, which functions as the electro-conductivity imparting agent, as the filler. A required amount of the filler is blended as appropriate in accordance with characteristics expected from a molded product.

The inventors of the present disclosure would like to state ideas below regarding reasons why the electrophotographic member of the present disclosure can suppress sticking attributed to scratches on the electrophotographic member or to the toner when printing multiple sheets under a high-temperature environment.

First, the electrophotographic member of the present disclosure is different from a conventional electrophotographic member in that the binder resin in the vicinity of the surface has high hardness and that the electrophotographic member includes the protrusions provided with the inorganic particles that are exposed to the surface through the vary hard binder resin. Since the binder resin in the vicinity of the surface is designed to be very hard, the surface of the electrophotographic member has excellent durability against abrasion and the like. Moreover, the increase in hardness of the binder resin on the surface makes it possible to suppress tackiness or bleeding specific to the resin. As a consequence, the electrophotographic member of the present disclosure can also show evident superiority regarding sticking or deposition originating from the toner.

In addition, the electrophotographic member of the present disclosure has the characteristics on its surface as have specifically been described with reference to FIG. 1B. To be more precise, in the electrophotographic member of the present disclosure, the elastic layer 12 at least contains the inorganic particles 13 and the binder resin 14 as shown in FIG. 1B, and the protrusions 15 are provided on the outer surface thereof. Meanwhile, the protrusions 15 contain the inorganic particles 13 and the binder resin 14 is present among the inorganic particles 13. Moreover, at least part of the inorganic particles 13 are held in the state of being exposed to the surface.

For this reason, when the electrophotographic member of the present disclosure is used as a member such as a developing unit that comes into contact with the electrophotographic member, these fine protrusions 15 are thought to function as a brush on a surface of a component such as an image bearing member and a toner amount regulating member, thus manifesting the scraping ability or a so-called cleaning effect.

Meanwhile, particulates of a metal oxide such as aluminum oxide, titanium oxide, and silica are generally added to the toner as an external additive for the purposes of improving charging stability, durable developing performance, fluidity, and durability. These particulates used as the external additive to the toner have a very small grain size. Accordingly, the particulates may be desorbed from the toner as a consequence of repeated endurance and deposited on surfaces of the respective members. Thus, the particulates may cause disadvantages in some cases. On the other hand, these particulates may be deposited on the surfaces of the respective members and sediments thus formed may function as a starter of irregularities to develop sticking originating from the toner. Moreover, since these particulates contain the metal oxide, it is extremely difficult to scrape these sediments off by using soft irregularities of conventional resin particles and the like.

In the electrophotographic member of the present disclosure, the binder resin in the above-described protrusions is designed to provide high hardness. Moreover, the inorganic particles are held in the state of being exposed to the protrusions. Accordingly, the inorganic particles exposed to the protrusions can directly act on the sediments of the metal oxide particulates originating from the toner and scape the sediments off effectively. In the meantime, since the binder resin being present between the inorganic particles has the high hardness, it is possible to keep holding the inorganic particles onto the surface even in the case where a large number of sheets are printed, that is, in the case of many opportunities of frictions, and to maintain the scraping ability throughout the endurance. This effect can suppress accumulation of stains on the surfaces of the image bearing member and the toner amount regulating member. This is considered to be the reason why the occurrence of adverse effects on images can be suppressed by the electrophotographic member of the present disclosure.

In addition, in the configuration of the present disclosure, the vicinity of the surface of the electrophotographic member has the high hardness as discussed earlier. Nonetheless, the inside of the electrophotographic member retains softness so that the electrophotographic member can suppress scratches on surfaces the image bearing member and the like due to scraping as well as damages on the toner at a high level.

The toner is generally designed to have a grain size of several micrometers. Accordingly, by maintaining the softness of a position at a depth of 1.0 μm from the outer surface being the same order as the depth from the outer surface of the electrophotographic member in contact with the toner, it is possible to suppress deterioration of the toner due to the repeated frictions with the toner, and to significantly reduce the occurrence of filming and other disadvantages.

To be more precise, an elastic modulus E1 of the binder resin measured at a first region in a cross-section in a thickness direction of the elastic layer is equal to or above 1000 MPa. Here, the first region is a region between the outer surface of the elastic layer and a position at a depth of 0.1 μm from the outer surface of the elastic layer. Meanwhile, an elastic modulus E2 at a second region in the cross-section of the elastic layer may preferably be equal to or below 80% of the elastic modulus E1. Here, the second region is a region between a position at a depth of 1.0 μm from the outer surface and a position at a depth of 1.1 μm from the outer surface of the elastic layer. It is more preferable that the elastic modulus E2 is equal to or below 50% of the elastic modulus E1. In addition, the second region has sufficient elasticity when the elastic modulus E2 is equal to or below 100 MPa. Thus, the inventors have found out that the elastic layer manifests further improvement in scraping ability.

Here, since the second region located immediately below the protrusions on the outermost surface retains the elasticity, the functions of the protrusions having the high hardness and flexibility at bases thereof are brought about at the same time. Hence, the manifestation of the additional scraping ability that is not possible only with the hard surface is considered to have come into being. Here, the wording of "the outer surface of the elastic layer" when determining the first and second regions, it means a portion of the outer surface of the elastic layer where the inorganic particles are not exposed, i.e., a portion of the outer surface of the elastic layer where the protrusions do not exist.

(Formation of Elastic Layer)

As for a method of forming the elastic layer, it is possible to cite a method of forming an elastic layer on a substrate by heating and curing the material of the elastic layer as mentioned above at an appropriate temperature and for an appropriate time period in accordance with various molding methods, examples of which include extrusion molding, press molding, injection molding, liquid injection molding, cast molding, and the like. To be more precise, it is possible to form the elastic layer on the outer periphery of the substrate by injecting an uncured material for forming the elastic layer into a cylindrical mold in which the substrate is disposed, and then heating and curing this material.

(Surface Treatment)

The elastic layer formed in accordance with the above-described method is subjected to a surface treatment, thereby removing the portion of the binder resin on the outermost surface. Thus, it is possible to form the protrusions containing the inorganic particles and the binder resin on the outermost surface of the elastic layer, and to expose at least part of the inorganic particles constituting the respective protrusions to the surfaces of the protrusions.

An appropriate surface treatment method needs to be selected and carried out in order to realize the configuration of the electrophotographic member of the present disclosure. General modes to carny out the surface treatment of the electrophotographic member include surface polishing, a corona treatment, a flame treatment, an ultraviolet treatment, an electron beam treatment, and the like. Among these modes, the inventors of the present disclosure have selected the ultraviolet treatment as an optimum method for providing the configuration of the electrophotographic member of the present disclosure. Specifically, the electrophotographic member of the present disclosure is preferably manufactured by subjecting the elastic layer to the ultraviolet treatment so as to form the protrusions by removing the binder resin on the outermost surface, and exposing at least part of the inorganic particles to the surfaces of the protrusions. Moreover, the configuration of the electrophotographic member according to the present disclosure is realized by appropriately selecting a wavelength and a treatment intensity of a light source used in the ultraviolet treatment, and controlling the hardness of the binder resin in the vicinity of the surface, the hardness of the binder resin of the inside, the degree of exposure of the inorganic particles, and so forth.

Here, it is preferable to keep a high workpiece temperature during irradiation because the inorganic particles can be efficiently exposed by promoting decomposition and volatilization of the binder resin in this way. Nonetheless, it is preferable not to raise the workpiece temperature too high in order to suppress deterioration of the binder resin components on the surface. In this regard, the ultraviolet rays are emitted at low illuminance for a long time while gradually increasing gas emission, for example. Alternatively, in a case of high illuminance, it is effective to adopt a method of conducting irradiating operations several times while keeping each irradiating operation within a short period, for example.

In general, indices of the ultraviolet treatment is expressed by "integrated light intensity (mJ)=illuminance (mW)× time (s)". In order to achieve the desired hardness of the binder resin in the vicinity of the surface and exposure of the inorganic particles, the integrated light intensity is set preferably equal to or above 30000 mJ, or more preferably equal to or above 50000 mJ. By setting the high integrated light intensity, it is possible to decompose the binder resin components covering the inorganic particles which are hardly removed by polishing and the like. As a consequence, it is possible to achieve the configuration of the present disclosure by promoting exposure of the inorganic particles and the hardening of the binder resin in the vicinity of the surface. On the other hand, if the integrated light intensity is set too high, double bonds in the diene rubber which contribute to the cross-linking run low, and the binder resin components on the surface are deteriorated. As a consequence, it is difficult to maintain the high hardness of the binder resin. It is therefore preferable to set the integrated light intensity equal to or below 300000 mJ. In other words, the integrated light intensity is set preferably equal to or above 30000 mJ and equal to or below 300000 mJ, or more preferably equal to or above 50000 mJ and equal to or below 300000 mJ.

In the meantime, it is preferable to conduct the treatment by using ultraviolet rays in a lower wavelength range out of the entire ultraviolet wavelengths in order to maintain the softness of the inside while further increasing the hardness in the vicinity of the surface. In selecting the lower wavelength range, it is possible to achiever the more preferable configuration of the present disclosure by appropriately selecting the light source to be used, a filter to be used, and the like. A dominant wavelength of a generally used ultraviolet lamp is in a range from 100 to 400 nm. Examples of the lamp having this range as the dominant wavelength include an excimer lamp, a low pressure mercury lamp, a high pressure mercury lamp, and the like. Among them, it is preferable to use the excimer lamp as the lamp having the wavelength equal to or below 200 nm as the dominant wavelength.

It is possible to achieve the configuration of the electrophotographic member according to the present disclosure by carrying out the surface treatment as described above. However, it is preferable to carry out the surface treatment in two stages from the viewpoint of further improving durability (longer operating life) of the electrophotographic member. Specifically, a surface treatment targeted for hardening of the binder resin that is present between the inorganic particles is carried out as a first surface treatment in order to prevent the inorganic particles to be eventually exposed to the outer surface from falling off. To be more precise, the surface treatment is carried out by using ultraviolet rays in a high wavelength range, which has an effect to harden a relatively inner region of the elastic layer to encourage the hardening of the binder resin in the vicinity of the inorganic particles inside the elastic layer before the inorganic particles are exposed. In this case, the irradiation is carried out at low illuminance for a long time while gradually increasing the gas emission as mentioned above in order to suppress deterioration in quality of the binder resin components on the surface. Alternatively, it is also useful to adopt methods such as a method of carrying out the irradiation for a short period several times in the case of high illuminance.

Subsequently, a second surface treatment is carried out in order to expose the inorganic particles. As described above, it is preferable to carry out the second surface treatment by using the ultraviolet rays in the lower wavelength range out of the entire ultraviolet wavelengths.

<Electrophotographic Process Cartridge and Electrophotographic Image Forming Apparatus>

Figure 2:
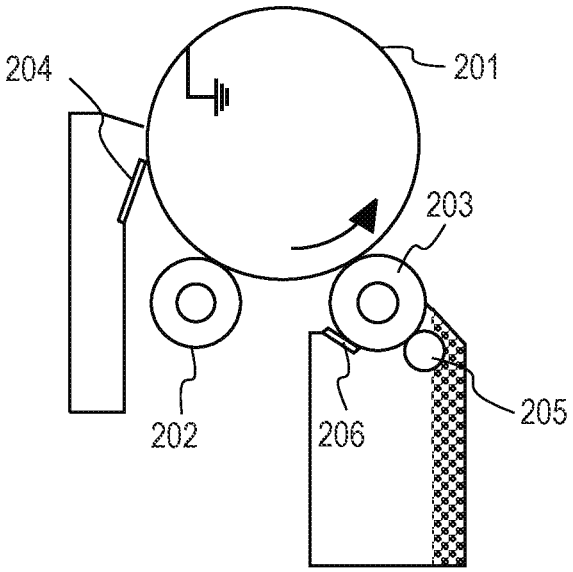
FIG. 2 is a schematic diagram showing an example of an electrophotographic process cartridge according to the present disclosure.
Figure 3:
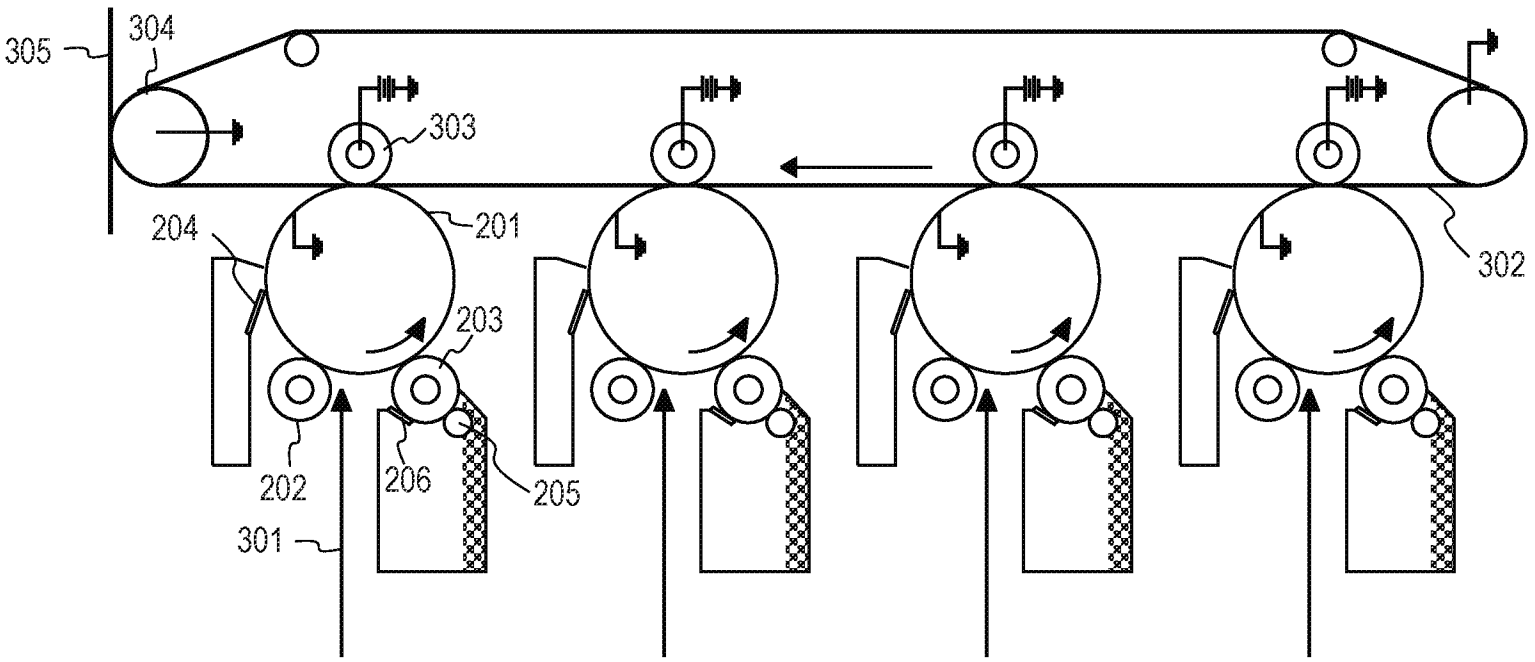
FIG. 3 is a schematic diagram showing an example of an electrophotographic image forming apparatus according to the present disclosure.

An electrophotographic process cartridge according to an aspect of the present disclosure is an electrophotographic process cartridge configured to be attachable to and detachable from a body of an electrophotographic image forming apparatus, which includes the electrophotographic member of the present disclosure. Meanwhile, an electrophotographic image forming apparatus according to an aspect of the present disclosure is an electrophotographic image forming apparatus which includes an image bearing member configured to bear an electrostatic latent image, a charging device configured to primarily charge the image bearing member, an exposure device configured to form the electrostatic latent image on the primarily charged image bearing member, a developing unit configured to form a toner image by developing the electrostatic latent image with a toner, and a transfer device configured to transfer the toner image to a transfer material. Here, the electrophotographic image forming apparatus includes the electrophotographic member of the present disclosure as the developing unit. FIGS. 2 and 3 are schematic diagrams showing an example of the electrophotographic process cartridge and an example of the electrophotographic image forming apparatus of the present disclosure.

The electrophotographic process cartridge shown in FIG. 2 includes an image bearing member 201, a charging member 202, a developing unit 203, a cleaning member 204, a toner supply member 205, and a toner regulating member 206. Moreover, the electrophotographic process cartridge is configured to be attachable to and detachable from the body of the electrophotographic image forming apparatus shown in FIG. 3.

The image bearing member 201 is uniformly charged (primarily charged) by the charging member 202 that is connected to a not-illustrated bias power supply. Next, the image bearing member 201 is irradiated with exposure light 301 from a not-illustrated exposure device in order to draw the electrostatic latent image thereon. Thus, the electrostatic latent image is formed on a surface of the image bearing member. Any of LED light and laser light is applicable to the exposure light.

Next, the toner charged to the negative polarity by the developing unit 203 is attached to the electrostatic latent image and the toner image is formed on the image bearing member. Thus, the electrostatic latent image is converted into a visible image (development). In this instance, a voltage is applied from the not-illustrated bias power supply to the developing unit 203. Here, the developing unit 203 is in contact with the image bearing member 201 while retaining a nip width equal to or above 0.5 mm and equal to or below 3 mm, for example. The toner image developed on the image bearing member 201 is primarily transferred to an intermediate transfer belt 302. A primary transfer member 303 is in contact with a back surface of the intermediate transfer belt. Accordingly, the toner image having the negative polarity is primarily transferred from the image bearing member 201 to the intermediate transfer belt 302 by applying the voltage to the primary transfer member 303. The primary transfer member 303 may have a shape of a member or a shape of a blade.

When the electrophotographic image forming apparatus is a full-color image forming apparatus, the above-mentioned series of processes including the charge, the exposure, the development, and the primary transfer are carried out for each of the following colors, namely, yellow color, cyan color, magenta color, and black color. To this end, a total of four electrophotographic process cartridges each containing one of the corresponding colors mentioned above are detachably attached to the body of the electrophotographic image forming apparatus shown in FIG. 3. Moreover, the above-mentioned series of processes including the charge, the exposure, the development, and the primary transfer are sequentially executed with a certain time lag in between, thus creating a state of overlapping the toner images of the four colors on the intermediate transfer belt 302 so as to represent a full-color image.

The toner images on the intermediate transfer belt 302 are transported to a position opposed to a secondary transfer member 304 along with rotation of the intermediate transfer belt. A print sheet 305 is transported at a predetermined timing along a transportation route to a space between the intermediate transfer belt 302 and the secondary transfer member 304, and the toner images on the intermediate transfer belt 302 are transferred to the print sheet 305 by applying a secondary transfer bias voltage to the secondary transfer member 304. The print sheet 305 to which the toner images are transferred by the secondary transfer member 304 is transported to a fixing device. Thereafter, the toner images on the print sheet 305 are melted and fixed by using the fixing device, and then the print sheet 305 is discharged from the electrophotographic image forming apparatus. Thus, the printing operation is completed.

According to an aspect of the present disclosure, it is possible to obtain the electrophotographic member which is usable as the developing unit that can prevent the toner from sticking to the surface of the image bearing member even when the electrophotographic images are formed for a long period under a high-temperature and high-humidity environment by using the toners designed for low-temperature fixation. Meanwhile, according to another aspect of the present disclosure, it is possible to obtain the electrophotographic process cartridge and the electrophotographic image forming apparatus, which contribute to stable formation of high-quality electrophotographic images.

EXAMPLES

The present disclosure will be specifically described below with reference to examples. It is to be noted, however, that the present disclosure is not limited only to these examples.

Example 1

<1. Manufacturing of Electrophotographic Member>

(Preparation of Substrate)

A mandrel made of stainless steel (SUS304) with an outside diameter of 6 mm and a length of 270 mm was procured. The mandrel serving as the substrate was prepared by applying an electro-conductive vulcanization adhesive (product name: METALOC U-20, manufactured by Toyokagaku Kenkyusho Co., Ltd.) on a peripheral surface of the mandrel and then baking the adhesive.

(Formation of Elastic Layer)

A mixture A was obtained by mixing materials for the elastic layer shown in Table 1 below at a filling rate of 70% by volume and a blade rotation speed of 30 rpm for 16 minutes by using a 6-liter pressure kneader (product name: TD6-15MDX, manufactured by Toshin Co., Ltd.).

TABLE 1

| Material | Parts by mass |
|---|---|
| acrylonitrile butadiene rubber (NBR) (product name: N230SV, manufactured by JSR Corporation) | 60 |
| epichlorohydrin rubber (product name: EPION 301, manufactured by Osaka Soda Co., Ltd.) | 40 |
| zinc oxide (grain size 0.28 μm, manufactured by Sakai Chemical Industry Co., Ltd.) | 5 |
| calcium carbonate (product name: NANOX #30, manufactured by Maruo Calcium Co., Ltd.) | 20 |
| carbon black (product name: TOKABLACK #7400, manufactured by Tokai Carbon Co., Ltd.) | 40 |

Subsequently, materials shown in Table 2 below were subjected to rolling to the right and left for a total of twenty times by using an open roll having a roll diameter of 12 inches (0.30 m) at a forward roll rotation speed of 10 rpm, a backward roll rotation speed of 8 rpm, and a roll clearance of 2 mm. Thereafter, a mixture B was obtained by carrying out tight milling for ten times while setting the roll clearance to 0.5 mm.

TABLE 2

| Material | Parts by mass |
|---|---|
| mixture A | 200 |
| sulfur | 1.2 |
| tetrabenzylthiuramdisulfide (product name: NOCCELER TBzTD, manufactured by Ouchi Shinko Chemical Industrial Co., Ltd.) | 4.5 |

Next, the mixture B was extruded together with the mandrel while forming the mixture B into a cylindrical shape coaxially with the mandrel located at the center by means of extrusion molding using a crosshead, thus forming a layer of the mixture B on an outer peripheral surface of the mandrel. The extruder used therein had specifications of a cylinder diameter of 45 mm (ϕ45) and L/D=20. As for temperature adjustment during extrusion, a temperature of a head was set to 90° C., a temperature of the cylinder was set to 90° C., and a temperature of a screw was set to 90° C. Two ends of the layer of the mixture B in a longitudinal direction of the mandrel were cut off, whereby the length of the layer of the mixture B in the longitudinal direction of the mandrel was set to 237 mm.

Thereafter, the mandrel was heated in an electric furnace at a temperature of 160° C. for 40 minutes. Thus, a vulcanized member was formed by vulcanizing the layer of the mixture B. Subsequently, an abrasive roller was obtained by polishing a surface of the vulcanized member with a grinder adopting a plunge-cut grinding method. Here, an outside diameter of the abrasive roller was measured by using a laser end measuring machine (product names: controller LS-7000, sensor head LS-7030R, manufactured by Keyence Corporation). The outside diameter was measured at a pitch of 10 mm in the longitudinal direction, and a difference between the outside diameter at a position away by 10 mm from a member end and the outside diameter at a center of the member was defined as a crown amount. The obtained outside diameter of the member end of the obtained abrasive roller was 11.998 mm and the outside diameter of the center of the member thereof was 12.048 mm. The crown amount was 50 μm.

The surface of the obtained abrasive roller was subjected to the following surface treatments.

<First Surface Treatment>

The surface treatment targeted for hardening of the binder resin between the inorganic particles was carried out in order to prevent the inorganic particles to be eventually exposed to the outer surface from falling off. To be more precise, the treatment was carried out by using ultraviolet rays on a high wavelength side having an effect to harden a relatively inner region of the elastic layer to encourage the hardening of the binder resin in the vicinity of the inorganic particles inside the elastic layer before the inorganic particles were exposed. In the meantime, the irradiation of the ultraviolet rays was kept within a short period at high illuminance in order to suppress the heat generation and to keep workpiece temperature low.

Figure 4:
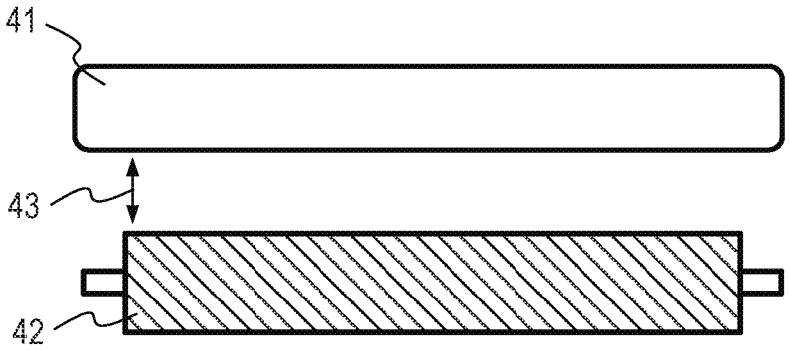
FIG. 4 is a schematic diagram showing a processing apparatus adopting an ultraviolet lamp used in the present disclosure.

FIG. 4 is a schematic diagram showing a processing apparatus used in this example.

An ultraviolet lamp 41 and an abrasive roller 42 used therein are arranged in parallel. A distance 43 between a surface of the ultraviolet lamp 41 and a surface of the abrasive roller 42 can be changed arbitrarily. Meanwhile, during the ultraviolet treatment, the abrasive roller 42 can be rotated by using a not-illustrated rotating mechanism.

The ultraviolet irradiation is carried out while rotating the abrasive roller 42 at a rotation speed of 20 rpm. In the meantime, there is an air vent located below the abrasive roller 42, so that an increase in temperature of the abrasive roller associated with the ultraviolet treatment can be suppressed by blowing the air from the air vent to the abrasive roller. Meanwhile, a glass plate or the like for controlling contamination of the filter and the lamp may be disposed between the ultraviolet lamp 41 and the abrasive roller 42 as appropriate.

A high pressure mercury lamp (manufactured by Eye Graphics Co., Ltd) was used as the ultraviolet lamp. The illuminance of ultraviolet rays having a wavelength of 365 nm at a position on the surface of the abrasive roller was measured with an accumulated ultraviolet meter (product names: UIT-250 (body), UVD-S365 (light receiving unit), manufactured by Ushio Inc.), and an output from the lamp and the distance 43 were adjusted so as to achieve the illuminance at 30 mW. Moreover, the surface of the abrasive roller was subjected to an air blow treatment such that the surface of the abrasive roller is kept from being heated. In this state, the first surface treatment was carried out while setting irradiation time to 167 seconds so as to achieve the integrated light intensity of about 5000 mJ.

<Second Surface Treatment>

The following surface treatment was carried out subsequently to the above-described first surface treatment.

An excimer UV lamp (product name: GEL40XTS, manufactured by Toshiba Lighting & Technology Corporation) was used as the ultraviolet lamp. The illuminance of ultraviolet rays having a wavelength of 172 nm at the position on the surface of the abrasive roller was measured with the accumulated ultraviolet meter (product names: UIT-250 (body), VUV-S172 (light receiving unit), manufactured by Ushio Inc.). In this instance, the distance 43 was adjusted so as to achieve the illuminance at 15 mW. In this state, the irradiation was carried out while setting irradiation time to 2000 seconds so as to achieve the integrated light intensity of 30000 mJ. However, the treatment was carried out in several batches so as to prevent the surface of the abrasive roller from reaching 100° C. or above.

Surface roughness Ra of the obtained electrophotographic member was measured with a contact surface roughness meter (product name: Surfcorder SE3500, manufactured by Kosaka Laboratory Ltd.). The measured value was Ra=1.05 μm.

<Measurement of Elastic Moduli of Binder Resin>

Figure 5:
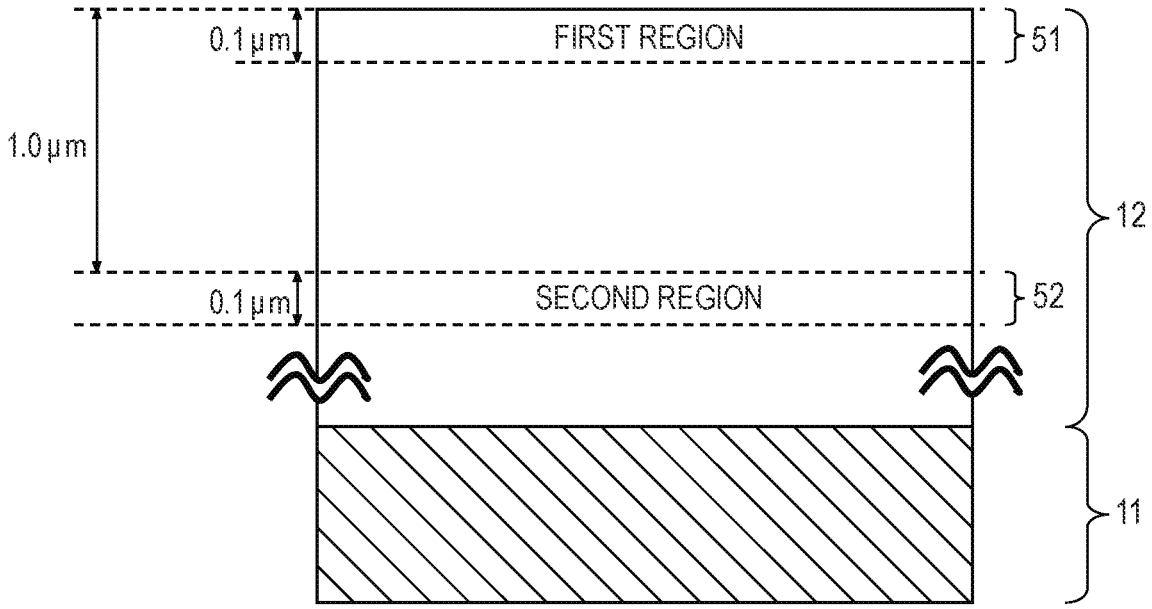
FIG. 5 is a schematic diagram showing an example of a cross-section of the electrophotographic member according to the present disclosure.

A region on a cross-section of the electrophotographic member subject to hardness measurement was cut out into a thin section with a diamond knife in a state of maintaining a temperature of −110° C. by using a cryo-microtome (product name: FC6, manufactured by Leica). The square thin section of 100-μm square and a width in a depth direction of 100 μm was thus produced. In the present disclosure, the elastic moduli of the binder resin were measured in terms of a first region 51 from the outer surface of the elastic layer 12 on the opposite side of the surface opposed to the substrate 11 to a depth of 0.1 μm, and of a second region 52 from a depth of 1.0 μm to 1.1 μm from the outer surface of the elastic layer 12 as shown in FIG. 5, respectively.

An SPM system (product name: MFP-3D Origin, manufactured by Oxford Instruments) and probes (product name: AC160, manufactured by Olympus Corporation) were used for the measurement. Force curves were measured for ten times to derive an arithmetic average of eight points while excluding the highest value and the lowest value. Then, each elastic modulus was calculated by using the Hertz theory.

The elastic modulus of the first region was defined as E1 while the elastic modulus of the second region was defined as the elastic modulus E2. The respective measured values turned out to be the elastic modulus E1=1527 (MPa) and the elastic modulus E2=98 (MPa). Results of the measurement are shown in Table 4.

<Abundance of Inorganic Particles>

Figure 6:
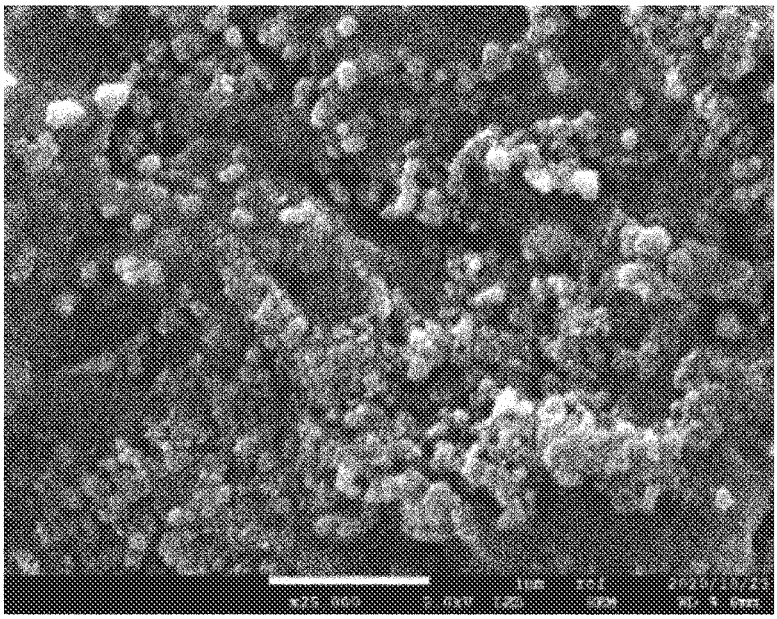
FIG. 6 is an observation photograph of a surface of the electrophotographic member after being subjected to an ultraviolet treatment according to Example 1 of the present disclosure.

Abundance of the inorganic particles on the surface of the electrophotographic member can be checked by observing the surface of the electrophotographic member by using a Schottky field emission scanning electron microscope (product name: JSM-7800F, manufactured by JEOL Ltd.). FIG. 6 shows an observation photograph of the surface of the electrophotographic member after being subjected to the ultraviolet treatment.

The observation took place with the magnification power of 25000× at ten locations each defined as some 3-μm square observation region. By adopting the magnification power and the observation region as mentioned above, it is possible to observe the inorganic particles sufficiently even when the grain size thereof is 1 μm or less, and to confirm that the inorganic particles are contained in the fine protrusions. Meanwhile, the degree of exposure of the inorganic particles to the surface can be checked in accordance with the following method.

The following analysis was conducted on the outermost surface and the inside of the obtained electrophotographic member. In this case, the outermost surface of the electrophotographic member was used as a sample of the surface. Meanwhile, a portion of the obtained electrophotographic member at a depth of 5 to 10 μm was cut out and data obtained by analyzing this portion was used as a sample of the inside.

Using the above-mentioned JSM-7800F, an EDX analysis was conducted with the magnification power of 500× while defining each observation region as some 200-μm square and applying the acceleration voltage of 5 kV. By setting the acceleration voltage to 5 kV, it is possible to suppress an amount of intrusion of the electron beam into each sample within several micrometers, thereby further increasing sensitivity of the degree of exposure to the surface. A result of each measurement point was obtained by selecting a detection peak originating from the inorganic particles from all the detected elements acquired by the EDX, and deriving an element content (atm %) at the relevant detection peak. In this example, zinc oxide was contained in the inorganic particles. Accordingly, the outermost surface was compared with the inside by using the peak of zinc.

The electrophotographic member was divided into equal thirds in the longitudinal direction (the width direction) thereof. Then, one sample was cut out of each of the regions thus obtained in such a way as to manifest a cross-section corresponding to the entire thickness of the elastic layer. Each of the three samples thus obtained was subjected to the EDX analysis of its surface corresponding to the outer surface of the electrophotographic member.

Next, each sample was subjected to the EDX analysis of its surface corresponding to a cross-section in the thickness direction of the elastic layer. In this instance, the region to be analyzed was determined as a portion located inward by 10 μm or above from the surface in terms of the thickness direction, and a result of this analysis was determined as a result of analysis of the inside. In the meantime, similar analyses were conducted on five points in the same sample while shifting the field of view of observation. The same analyses were conducted on each of the samples. Regarding the results of the fifteen points in total, average values were derived in terms of the outermost surface and the inside, respectively. Then, the element contents were compared with one another. As a consequence, the element content A obtained from the outermost surface was 0.45 atm % while the element content B obtained from the inside was 0.33 atm %. Results of the analyses are shown in Table 4.

<2. Evaluations of Electrophotographic Member>

The electrophotographic member obtained as described above was embedded as the developing unit into a cyan cartridge for a laser printer (product name: HP LaserJet Enterprise Color M553dn, manufactured by HP Inc.) in a high-temperature and a high-humidity environment at a temperature of 30° C. and a relative humidity of 95%. The cartridge was let stand for 48 hours in the same environment and was subjected to sufficient aging.

After the aging, images were continuously printed by adjusting a coverage rate to 0.5%. The printing was continued until a cartridge replacement lamp in the laser printer was turned on. Moreover, additional 500 sheets were printed after the lamp was turned on. Then, the cartridge was disassembled to remove the image bearing member and the developing unit. Each of these components was subjected to surface observation.

(Evaluation of Scraping Ability)

The surface of the image bearing member was observed with a laser microscope (product name: VK-8700, manufactured by Keyence Corporation) while using an object lens having magnification power of 20×. The scraping ability was evaluated from the state of the surface based on the following benchmarks:

A: An area of the sticking toner with respect to the total surface area of the image bearing member was equal to or below 1%:

B: The area of the sticking toner was above 1% and equal to or below 5%; and

C: The area of the sticking toner was above 5%, or a vertical streak originating from the image bearing member was observed on the image.

Here, a determination as to whether or not the vertical streak on the image originated from the image bearing member was made by carrying out the printing after replacing the used image bearing member with a new image bearing member and then checking whether or not the vertical stream disappeared by comparing the images before and after the replacement.

(Filming Evaluation)

A surface of the collected developing unit was subjected to air blow in order to remove the toner therefrom. Then, the surface was observed with the laser microscope (product name: VK-8700, manufactured by Keyence Corporation) while using the object lens having magnification power of 20× likewise. The state of filming was evaluated based on the following benchmarks:

A: An area of the sticking toner with respect to the total surface area of the developing unit was equal to or below 5%, which represented particularly favorable filming resistance;

B: The area of the sticking toner was above 5% and equal to or below 15%, which represented favorable filming resistance; and C: The area of the sticking toner was above 15%, which represented poor filming resistance.

(Durability Evaluation)

After carrying out the above-described filming evaluation, the surface of the developing unit was cleaned with ethanol. Then, the surface was observed again with the same laser microscope to evaluate durability based on the following benchmarks:

A: No scrapes or cracks attributed to frictions with other members were observed on the outermost surface, which represented excellent durability:

B: Very fine cracks (in several micrometers) were found on the outermost surface; and C: Cracks larger than toner grain size and clogged with the toner and the like were found on the outermost surface, or a measurably large flaw was found on the outermost surface.

Examples 2 to 4

The electrophotographic members of the present disclosure were obtained as with Example 1 except that the treatments were carried out while setting the irradiation time in the <second surface treatment> such that the integrated light intensities on the surface of the abrasive roller achieved the integrated light intensities as shown in Table 4, respectively.

The electrophotographic members thus obtained were subjected to the same evaluations as those conducted in Example 1. Results are shown in Table 4.

Example 5

A low pressure mercury ozone-free lamp (manufactured by Toshiba Lighting & Technology Corporation) was adopted as the lamp used in the <second surface treatment>. The illuminance of ultraviolet rays having a wavelength of 254 nm on the surface of the abrasive roller was measured with the accumulated ultraviolet meter (product names: UIT-250 (body), UVD-S254 (light receiving unit), manufactured by Ushio Inc.). The distance was adjusted so as to achieve the illuminance at 33 mW. Thereafter, the irradiation time was adjusted to achieve the integrated light intensity of 30000 mJ. Except for the above-mentioned configurations, the electrophotographic member was obtained by carrying out the same treatments as those in Example 1.

The electrophotographic members thus obtained were subjected to the same evaluations as those conducted in Example 1. Results are shown in Table 4.

Examples 6 to 8

The electrophotographic members of the present disclosure were obtained as with Example 5 except that the treatments were carried out while setting the irradiation time in the <second surface treatment> such that the integrated light intensities on the surface of the abrasive roller achieved the integrated light intensities as shown in Table 4, respectively.

The electrophotographic members thus obtained were subjected to the same evaluations as those conducted in Example 1. Results are shown in Table 4.

Example 9

The high pressure mercury lamp (manufactured by Eye Graphics Co., Ltd) was adopted as the lamp used in the <second surface treatment>. The illuminance of ultraviolet rays having the wavelength of 365 nm on the surface of the abrasive roller was measured with the accumulated ultraviolet meter (product names: UIT-250 (body), UVD-S365 (light receiving unit), manufactured by Ushio Inc.). Then, the distance was adjusted so as to achieve the illuminance at 30 mW. Thereafter, the irradiation time was adjusted to achieve the integrated light intensity of 30000 mJ. Except for the above-mentioned configurations, the electrophotographic member was obtained by carrying out the same treatments as those in Example 1.

The electrophotographic members thus obtained were subjected to the same evaluations as those conducted in Example 1. Results are shown in Table 4.

Examples 10 to 12

The electrophotographic members of the present disclosure were obtained as with Example 9 except that the treatments were carried out while setting the irradiation time in the <second surface treatment> such that the integrated light intensities on the surface of the abrasive roller achieved the integrated light intensities as shown in Table 4, respectively.

The electrophotographic members thus obtained were subjected to the same evaluations as those conducted in Example 1. Results are shown in Table 4.

Example 13

In Example 1, the <second surface treatment> was conducted without carrying out the <first surface treatment>. Moreover, in the <second surface treatment>, the treatment was conducted continuously regardless of the workpiece temperature. The electrophotographic member of the present disclosure was obtained by carrying out the irradiation so as to achieve the integrated light intensity of 3000 mJ.

The electrophotographic members thus obtained were subjected to the same evaluations as those conducted in Example 1. Results are shown in Table 4.

Example 14

In Example 5, the <second surface treatment> was conducted without carrying out the <first surface treatment>. Moreover, in the <second surface treatment>, the treatment was conducted continuously regardless of the workpiece temperature. The electrophotographic member of the present disclosure was obtained by carrying out the irradiation so as to achieve the integrated light intensity of 3000 mJ.

The electrophotographic members thus obtained were subjected to the same evaluations as those conducted in Example 1. Results are shown in Table 4.

Example 15

In Example 9, the <second surface treatment> was conducted without carrying out the <first surface treatment>. Moreover, in the <second surface treatment>, the treatment was conducted continuously regardless of the workpiece temperature. The electrophotographic member of the present disclosure was obtained by carrying out the irradiation so as to achieve the integrated light intensity of 3000 mJ.

The electrophotographic members thus obtained were subjected to the same evaluations as those conducted in Example 1. Results are shown in Table 4.

Example 16

The abrasive roller was obtained as with Example 1. This abrasive roller was subjected to the <first surface treatment> as with Example 1, and then subjected to an electron beam treatment as the <second surface treatment> instead of the ultraviolet treatment.

Figure 7:
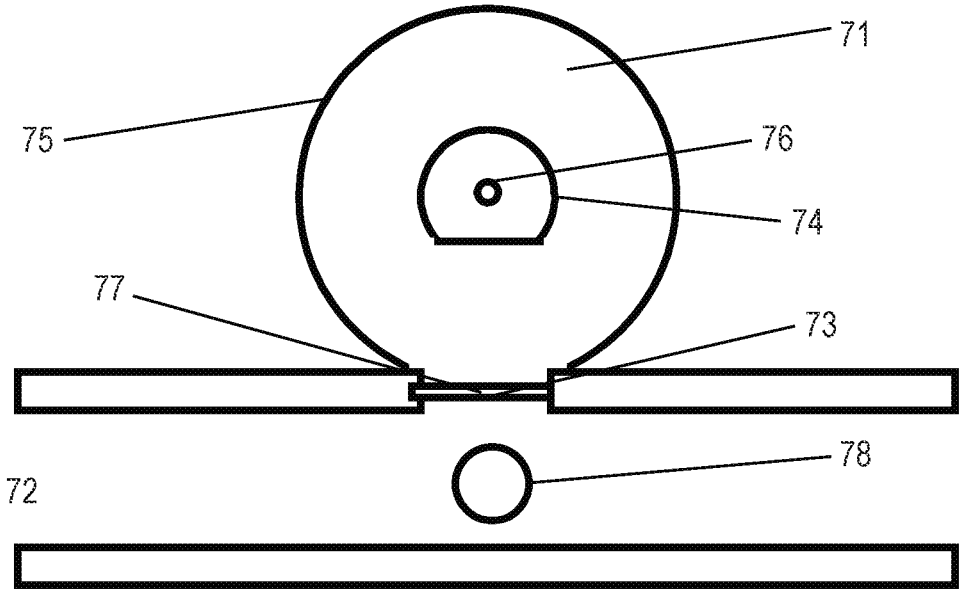
FIG. 7 is a schematic diagram showing an electron beam irradiator used in Example 16 of the present disclosure.

FIG. 7 shows a schematic diagram of an electron beam irradiator. The electron beam irradiator usable in the present disclosure is preferably configured to irradiate the surface of the member with an electron beam while rotating the abrasive roller. The electron beam irradiator is, for example, an apparatus which includes an electron beam generator 71, an irradiation chamber 72, and an irradiation port 73 as shown in FIG. 7.

The electron beam generator 71 includes a terminal 74 that generates the electron beam, and an accelerator tube 75 that accelerates the electron beam, which is generated by the terminal 74, in a vacuum space (an acceleration space). Meanwhile, inside of the electron beam generator is kept in vacuum being equal to or above $10^{-3}$ Pa and equal to or below $10^{-6}$ Pa by using a not-illustrated vacuum pump or the like in order to prevent electrons from colliding with gas molecules and losing energy. A filament 76 emits thermal electron when the filament 76 is heated by a current supplied from a not-illustrated power supply. Among the thermal electrons, only those passing through the terminal 74 are effectively taken out as the electron beam. Then, the electron beam is accelerated in the acceleration space inside the accelerator tube 75 by the acceleration voltage. Then, the electron beam penetrates an irradiation port foil 77 and is emitted onto an abrasive roller 78 that is transported inside the irradiation chamber 72 below the irradiation port 73. When emitting the electron beam onto the abrasive roller 78, the inside of the irradiation chamber 72 may be filled with a nitrogen atmosphere. Meanwhile, the abrasive roller 78 is rotated by a not-illustrated rotating mechanism, and is moved inside the irradiation chamber 72 by a transportation unit.

Using the above-described electron beam irradiator, the electrophotographic member was obtained by subjecting the abrasive roller to the electron beam treatment at the acceleration voltage of 50 kV for such irradiation time that corresponds to a dose of 450 kGy.

The electrophotographic members thus obtained were subjected to the same evaluations as those conducted in Example 1. Results are shown in Table 4.

Comparative Example 1

The electrophotographic member was obtained as with Example 1 except that the treatments were carried out while setting the irradiation time in the <second surface treatment> such that the integrated light intensity on the surface of the abrasive roller became 10000 mJ.

The electrophotographic members thus obtained were subjected to the same evaluations as those conducted in Example 1. Results are shown in Table 4.

Comparative Example 2

The electrophotographic member was obtained as with Example 5 except that the treatments were carried out while setting the irradiation time in the <second surface treatment> such that the integrated light intensity on the surface of the abrasive roller became 10000 mJ.

The electrophotographic members thus obtained were subjected to the same evaluations as those conducted in Example 1. Results are shown in Table 4.

Comparative Example 3

The electrophotographic member was obtained as with Example 9 except that the treatments were carried out while setting the irradiation time in the <second surface treatment> such that the integrated light intensity on the surface of the abrasive roller became 10000 mJ.

The electrophotographic members thus obtained were subjected to the same evaluations as those conducted in Example 1. Results are shown in Table 4.

Comparative Example 4

Five kinds of materials shown in Table 3 were agitated and mixed together. Then, a mixture thus obtained was dissolved in and mixed with methyl ethyl ketone (manufactured by Aldrich) such that its solid content concentration became 25% by mass. Thereafter, a coating material for a surface layer was obtained by uniformly dispersing the mixture with a sand mill. Note that blending quantities (parts by mass) of the respective materials shown in Table 3 represent blending quantities as solid contents. Specifically, the respective materials were weighed and used such that masses after removing solvents in the respective materials became equal to the parts by mass in the table.

The abrasive roller obtained as with Example 1 was dipped in the obtained coating material for the surface layer. Thus, a coated film in a film thickness of about 15 μm was formed on the abrasive roller. Then, the coated film was dried and hardened by heating the coated film at a temperature of 130° C. for 60 minutes. Then, the same surface treatments and evaluations as those of Example 1 were carried out. Results are shown in Table 4.

However, concerning the <abundance of inorganic particles>, the calculation was carried out by using a detection value of aluminum because alumina particles were used as the inorganic particles.

TABLE 3

| Material | Product name | Parts by mass |
|---|---|---|
| alumina dispersion | NANO-BYK 3601 (manufactured by BYK) | 30 |
| polyesterpolyol | Nippollan 3027 (manufactured by Tosoh Corporation) | 50 |
| isocyanate | Coronate 2233 (manufactured by Tosoh Corporation) | 50 |
| ionically conductive material | bis(trifluoromethanesulfonyl)imide lithium | 2 |
| roughening particles | Art Pearl C400 (manufactured by Negami Chemical Industrial Co., Ltd.) | 15 |

TABLE 4

| | Second Surface Treatment | | | | | | | | | | | |
|---|---|---|---|---|---|---|---|---|---|---|---|---|
| | Light Source | Wavelength (nm) | Integrated Light Intensity (mJ) | E1 (MPa) | E2 (MPa) | E2/E1 | A (atm %) | B (atm %) | A/B | Scraping Ability | Filming | Durability |
| Example 1 | excimer UV lamp | 172 | 30000 | 1527 | 98 | 6.4% | 0.45% | 0.33% | 1.36 | A | A | A |
| Example 2 | excimer UV lamp | 172 | 50000 | 2432 | 162 | 6.7% | 0.50% | 0.33% | 1.52 | A | B | A |
| Example 3 | excimer UV lamp | 172 | 80000 | 3040 | 180 | 5.9% | 0.62% | 0.33% | 1.88 | A | B | A |
| Example 4 | excimer UV lamp | 172 | 120000 | 3800 | 212 | 5.6% | 0.72% | 0.33% | 2.18 | A | B | A |
| Example 5 | low pressure mercury lamp | 254 | 30000 | 1327 | 278 | 20.9% | 0.47% | 0.33% | 1.43 | A | B | B |
| Example 6 | low pressure mercury lamp | 254 | 50000 | 2139 | 292 | 13.7% | 0.52% | 0.33% | 1.58 | A | B | A |
| Example 7 | low pressure mercury lamp | 254 | 80000 | 2674 | 325 | 12.1% | 0.52% | 0.33% | 1.58 | A | B | A |
| Example 8 | low pressure mercury lamp | 254 | 120000 | 3342 | 382 | 11.4% | 0.64% | 0.33% | 1.94 | A | B | A |
| Example 9 | high pressure mercury lamp | 365 | 30000 | 1117 | 791 | 70.8% | 0.38% | 0.33% | 1.15 | B | B | B |
| Example 10 | high pressure mercury lamp | 365 | 50000 | 1595 | 889 | 55.7% | 0.45% | 0.33% | 1.36 | A | B | A |
| Example 11 | high pressure mercury lamp | 365 | 80000 | 1994 | 812 | 40.7% | 0.49% | 0.33% | 1.48 | A | B | A |
| Example 12 | high pressure mercury lamp | 365 | 120000 | 2493 | 889 | 35.7% | 0.51% | 0.33% | 1.54 | A | B | A |

TABLE 4-continued

| | Second Surface Treatment | | | | | | | | | | | |
|---|---|---|---|---|---|---|---|---|---|---|---|---|
| | Light Source | Wavelength (nm) | Integrated Light Intensity (mJ) | E1 (MPa) | E2 (MPa) | E2/E1 | A (atm %) | B (atm %) | A/B | Scraping Ability | Filming | Durability |
| Example 13 | excimer UV lamp | 172 | 30000 | 1482 | 82 | 5.5% | 0.41% | 0.33% | 1.24 | B | A | A |
| Example 14 | low pressure mercury lamp | 254 | 30000 | 1280 | 266 | 20.8% | 0.42% | 0.33% | 1.29 | B | B | A |
| Example 15 | high pressure mercury lamp | 365 | 30000 | 1012 | 752 | 74.3% | 0.40% | 0.33% | 1.21 | B | B | B |
| Example 16 | electron beam treatment | — | — | 1056 | 1038 | 98.3% | 0.36% | 0.33% | 1.09 | B | C | C |
| Comparative Example 1 | excimer UV lamp | 172 | 10000 | 612 | 18 | 2.9% | 0.38% | 0.33% | 1.15 | C | A | C |
| Comparative Example 2 | low pressure mercury lamp | 254 | 1000 | 482 | 32 | 6.6% | 0.35% | 0.33% | 1.06 | C | A | C |
| Comparative Example 3 | high pressure mercury lamp | 365 | 10000 | 312 | 45 | 14.4% | 0.33% | 0.33% | 1.00 | C | A | C |
| Comparative Example 4 | excimer UV lamp | 172 | 30000 | 20 | 18 | 90.0% | 2.34% | 1.52% | 1.54 | C | A | C |

As a result of comparison among Examples 1 to 4, 5 to 8, and 9 to 12, it is apparent that an increase of the elastic modulus E2 that represents the hardness of the inside of the electrophotographic member can be suppressed by using the ultraviolet rays having the wavelength in the lower wavelength range. Moreover, these results suggest that the filming performance being a deterioration index of the toner is dramatically changed by suppressing the increase of the elastic modulus E2.

Meanwhile, when Examples 13 to 15 are compared with Examples 1, 5, and 9, only the second surface treatment was carried out and the surface treatment was continuously carried out in Examples 13 to 15. Unlike these examples, the surface treatment at the high illuminance was carried out as the first surface treatment and then the second surface treatment was carried out several times so as not to raise the workpiece temperature in Examples 1, 5, and 9. The results of these evaluations suggest that a more preferable mode of the electrophotographic member of the present disclosure can be obtained not only by simply increasing the integrated light intensity but also by devising the treatment method depending on the purposes.

In the meantime, the integrated light intensity is increased in the respective examples in order to increase a value A/B representing the degree of exposure of the inorganic particles. In this case, it is evident that the scraping ability is improved in proportion to the increase in this value. On the other hand, although the value A/B of Comparative Example 4 is increased, this comparative example does not use the diene rubber as the resin for forming the surface of the electrophotographic member. The elastic modulus E1 therefore indicates that the resin on the surface has not been hardened by cross-linking. Accordingly, in the case of printing multiple sheets, it is not possible to hold the inorganic particles exposed to the surface by using the resin, resulting in their eventual falling off. As a consequence, the scraping ability is lost at the end of the endurance.

Meanwhile, the result of Example 16 shows that the value of the elastic modulus E2 is raised in the case of using the electron beam for the surface treatment, which negatively affects the filming performance.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-050145, filed Mar. 24, 2021, which is hereby incorporated by reference herein in its entirety.

What is claimed is:

1. An electrophotographic member comprising:

an electro-conductive substrate;

an elastic layer;

an outer surface; and a protrusion on the outer surface, the elastic layer containing inorganic particles and a binder resin, the protrusion containing the inorganic particles, at least part of the inorganic particles contained in the protrusion being exposed to a surface of the protrusion, the binder resin being present among the inorganic particles contained in the protrusion, wherein when measuring an elastic modulus E1 of the binder resin at a first region in a cross section in a thickness direction of the elastic layer, where the first region is between an outer surface of the elastic layer and a position at a depth of 0.1 μm from the outer surface, the elastic modulus E1 is equal to or above 1000 MPa.

2. The electrophotographic member according to claim 1, wherein when measuring an elastic modulus E2 of the binder resin in a second region at the cross section in a thickness direction of the elastic layer, where the second region is between a position at a depth of 1.0 μm from the outer surface of the elastic layer and a position at a depth of 1.1 μm from the outer surface of the elastic layer, the elastic modulus E2 is equal to or below 80% of the elastic modulus E1.

3. The electrophotographic member according to claim 2, wherein the elastic modulus E2 is equal to or below 50% of the elastic modulus E1.

4. The electrophotographic member according to claim 2, wherein the elastic modulus E2 is equal to or below 100 MPa.

5. The electrophotographic member according to claim 1, wherein the binder resin includes at least a diene rubber.

6. The electrophotographic member according to claim 1, wherein when calculating an element content of the elastic layer from peak intensity originating from the inorganic particles obtained by an energy dispersive X-ray spectroscopy at an acceleration voltage of 5 kV, a value A is higher than a value B, where the value A is the element content of an outermost surface of the electrophotographic member, and the value B is the element content of inside of the electrophotographic member.

7. The electrophotographic member according to claim 6, wherein the value A is equal to or above 130% of the value B.

8. An electrophotographic process cartridge configured to be attachable to and detachable from a body of an electrophotographic image forming apparatus, comprising an electrophotographic member, wherein the electrophotographic member comprises an electroconductive substrate and an elastic layer, the elastic layer contains inorganic particles and a binder resin, the electrophotographic member has a protrusion on an outer surface of the electrophotographic member, the protrusion contains the inorganic particles, at least part of the inorganic particles contained in the protrusion is exposed to a surface of the protrusion, the binder resin is present among the inorganic particles contained in the protrusion, and wherein when measuring an elastic modulus E1 of the binder resin at a first region in a cross section in a thickness direction of the elastic layer, where the first region is between an outer surface of the elastic layer and a position at a depth of 0.1 μm from the outer surface, the elastic modulus E1 is equal to or above 1000 MPa.

9. An electrophotographic image forming apparatus comprising:

an image bearing member configured to bear an electrostatic latent image;

a charging device configured to primarily charge the image bearing member;

an exposure device configured to form the electrostatic latent image on the primarily charged image bearing member;

a developing unit configured to form a toner image by developing the electrostatic latent image with a toner; and a transfer device configured to transfer the toner image to a transfer material, wherein the developing unit comprises an electrophotographic member, wherein the electrophotographic member comprises an electro-conductive substrate and an elastic layer, the elastic layer contains inorganic particles and a binder resin, the electrophotographic member has a protrusion on an outer surface of the electrophotographic member, the protrusion contains the inorganic particles, at least part of the inorganic particles contained in the protrusion is exposed to a surface of the protrusion, the binder resin is present among the inorganic particles contained in the protrusion, and wherein when measuring an elastic modulus E1 of the binder resin at a first region in a cross section in a thickness direction of the elastic layer, where the first region is between an outer surface of the elastic layer and a position at a depth of 0.1 μm from the outer surface, the elastic modulus E1 is equal to or above 1000 MPa.

* * * * *